US007527844B2

(12) United States Patent
Tallier et al.

(10) Patent No.: US 7,527,844 B2
(45) Date of Patent: May 5, 2009

(54) WRAPPING PROVIDED WITH AN INSIDE COUPON

(75) Inventors: Bernard Tallier, Cortaillod (CH); Jean-Pierre Fiems, Neuchatel (CH); Marc Budin, Marin-Epagnier (CH)

(73) Assignee: Philip Morris USA Inc., Richmond, VA (US)

( * ) Notice: Subject to any disclaimer, the term of this patent is extended or adjusted under 35 U.S.C. 154(b) by 673 days.

(21) Appl. No.: 10/496,244

(22) PCT Filed: Nov. 8, 2002

(86) PCT No.: PCT/CH02/00604

§ 371 (c)(1),
(2), (4) Date: May 20, 2004

(87) PCT Pub. No.: WO03/043910

PCT Pub. Date: May 30, 2003

(65) Prior Publication Data

US 2005/0142316 A1 Jun. 30, 2005

(30) Foreign Application Priority Data

Nov. 20, 2001 (EP) ..... 01811115

(51) Int. Cl.

| | |
|---|---|
| ***A24F 15/00*** | (2006.01) |
| ***B32B 3/00*** | (2006.01) |
| ***B32B 9/00*** | (2006.01) |
| ***B32B 33/00*** | (2006.01) |
| ***B65D 65/28*** | (2006.01) |
| ***G09F 3/00*** | (2006.01) |

(52) U.S. Cl. ..... 428/43; 206/264; 428/40.1; 428/156

(58) Field of Classification Search ..... 428/43, 428/131, 156; 206/264
See application file for complete search history.

(56) References Cited

U.S. PATENT DOCUMENTS

| | | | | |
|---|---|---|---|---|
| 4,784,261 | A * | 11/1988 | Kutchin | 206/256 |
| 5,035,935 | A | 7/1991 | Thomas et al. | |
| 5,931,292 | A | 8/1999 | Focke | |
| 6,036,006 | A | 3/2000 | Focke | |
| 6,467,614 | B1 * | 10/2002 | Tallier et al. | 206/264 |

FOREIGN PATENT DOCUMENTS

| | | |
|---|---|---|
| EP | 0 803 450 B1 | 10/1997 |
| EP | 0 960 831 B1 | 12/1999 |

* cited by examiner

*Primary Examiner*—Elizabeth M Cole
*Assistant Examiner*—Brent T O'Hern
(74) *Attorney, Agent, or Firm*—Connolly Bove Lodge & Hutz LLP

(57) ABSTRACT

A wrapping is formed around at least one pack by wrapping film, and the pack has a receiving face against which a coupon is placed. The coupon is also positioned against an inner surface of the film between the pack and the film. Opening of the wrapping film is achieved by a tear strip which separates the film into two portions and which is situated, before tearing, disposed between the coupon and the film. The wrapping is characterized in that the coupon is fixed locally against the inner face of the film in such a way that, after opening of the film by the tear strip, the coupon remains attached to a single one of the first portion of the film, the second portion of film and the tear strip of the film.

10 Claims, 3 Drawing Sheets

WRAPPING PROVIDED WITH AN INSIDE COUPON

BACKGROUND OF THE INVENTION

The present invention relates to a wrapping provided with a coupon on at least one of its inside faces.

Wrappings, especially but not exclusively cigarette packs, are found provided on one face with a coupon which can be opened in order to be read, said coupon bearing publicity indications, directions for use, indications for a contest, or any other appropriate indications.

U.S. Pat. No. 5,035,935 describes a pack of cigarettes provided with such a coupon disposed under the outside transparent film covering the pack of cigarettes. A drawback of the means proposed is that it is not possible to open the pack of cigarettes and the coupon simultaneously.

Application EP-A-0 803 450 also describes a pack of cigarettes provided with a tax coupon under the outside transparent film. The coupon is attached to the surface of the web of film, which will be situated against the pack of cigarettes. The tear tape simultaneously permits opening of the transparent film and tearing of the tax coupon. Note that in this case, the tax coupon is not intended to be read after opening of the pack.

Application EP-A-0 960 831 concerns a pack of cigarettes which, covered with a transparent outer film, is provided with a coupon able to be opened upon opening said outer film. This recent solution has a drawback when one wishes to protect the coupon completely or to prevent access to this coupon before opening of the film.

This solution also has another drawback. Since the coupon is situated on the outside of the pack covered with film, this coupon has edges that can form as many abutments capable of impeding or hampering the displacements of said pack when it is supposed to be displaced and when its face, provided with the coupon, has to slide against the guide surfaces.

In fact, packs frequently have to be displaced in an installation for regrouping packs into lots, particularly with a view to packaging of lots of these packs.

Manufacturers of cigarettes wish to return to the old solution in which the coupon is placed inside the film without this return to said old solution being accompanied by known drawbacks.

SUMMARY OF THE INVENTION

The main object of the invention is therefore to propose a wrapping of one or of a plurality of packs or of objects, provided on at least one of its inside faces with a coupon which may be easily extracted from the wrapping.

Another object of the invention is to propose a wrapping, the opening of which by means of a tear strip simultaneously causes the opening of a coupon placed in this wrapping.

To achieve this object, the invention has as its subject matter a wrapping formed around at least one pack by means of a wrapping film, said pack having at least one face, referred to as receiving face, against which a coupon is placed having two external opposite faces which are:

- a first external face, placed against the receiving face of the pack, and
- a second external face, attached against a surface of the film which, referred to as inner surface, is itself situated turned toward the pack, the opening of the wrapping film being achieved by means of a tear strip which separates the film into two portions, which are a first portion and a second portion, and which is situated, before tearing, disposed between the coupon and the film, this wrapping being characterised in that the coupon is fixed locally against the inner face of the film in such a way that, after opening of said film by means of the tear strip, said coupon remains at least partly attached to a single one of said first portion of the film, second portion of the film and tear strip of said film.

BRIEF DESCRIPTION OF THE DRAWINGS

The invention will be better understood from reading the following description, given by way of non-limiting example, with reference to the attached drawings.

DETAILED DESCRIPTION OF THE INVENTION

Although the figures and the following description relate to a pack of cigarettes, the concepts of pack and of wrapping must be extended to any type of wrapping of any product on which a coupon can be disposed according to one or the other of the ways described.

The shape of the wrapping need also not be that of a parallelepiped as shown, but may be of a different shape, e.g., circular cylindrical.

Figure 1:
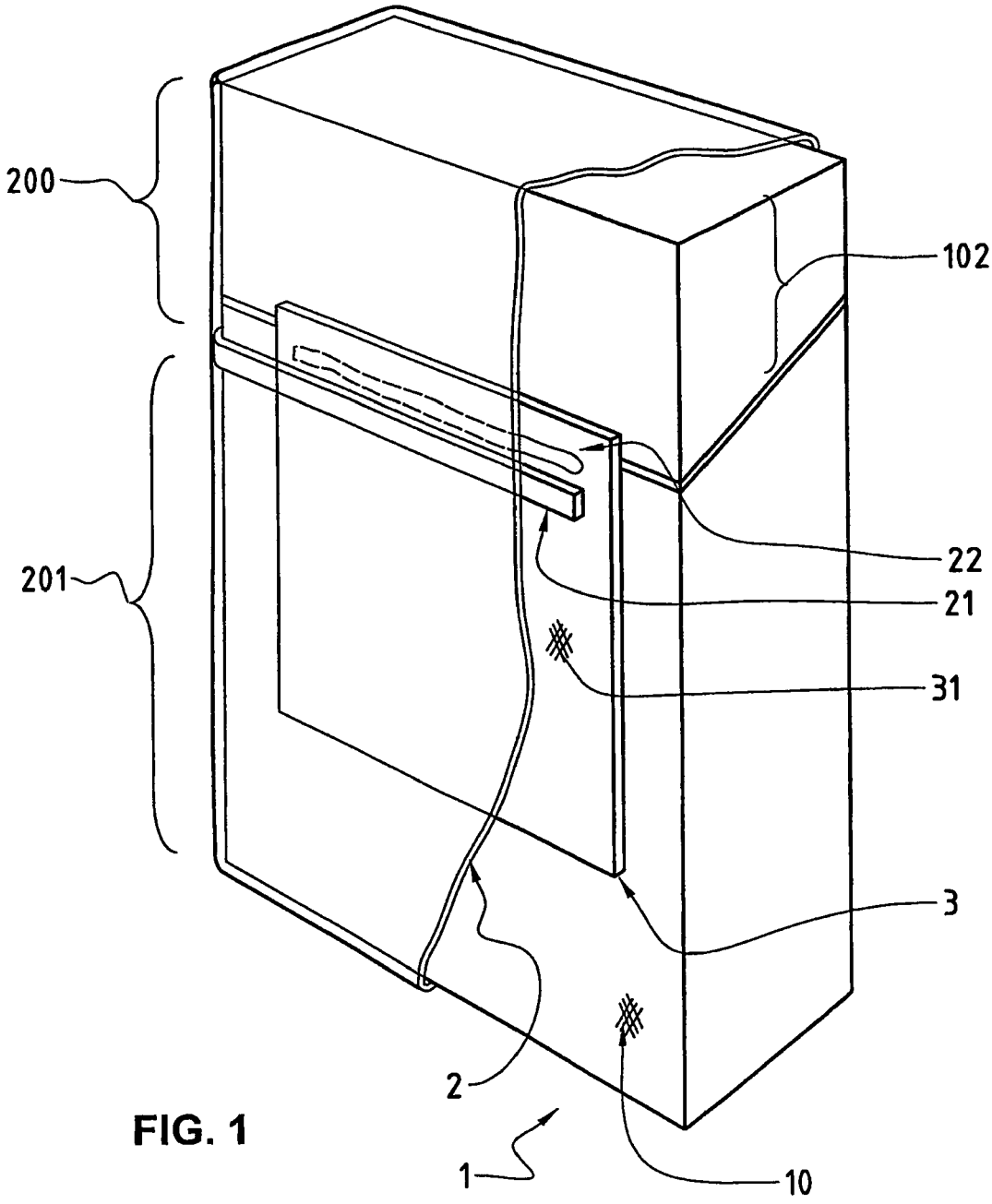
FIG. 1, a view in perspective of a wrapping made up of a film around a pack provided with a coupon on one of its faces, the wrapping film being represented partially torn in order to show the pack and the coupon that are covered, FIG. 2, a view in perspective of a wrapping made up of a film around a pack provided with a coupon on one of its faces, the wrapping film having been cut by means of a tear strip and having been separated into two portions, and FIG. 3, lateral and transversally expanded views showing a coupon as well as the pack which bears this coupon with a wrapping film that covers said pack and coupon.
Figure 2:
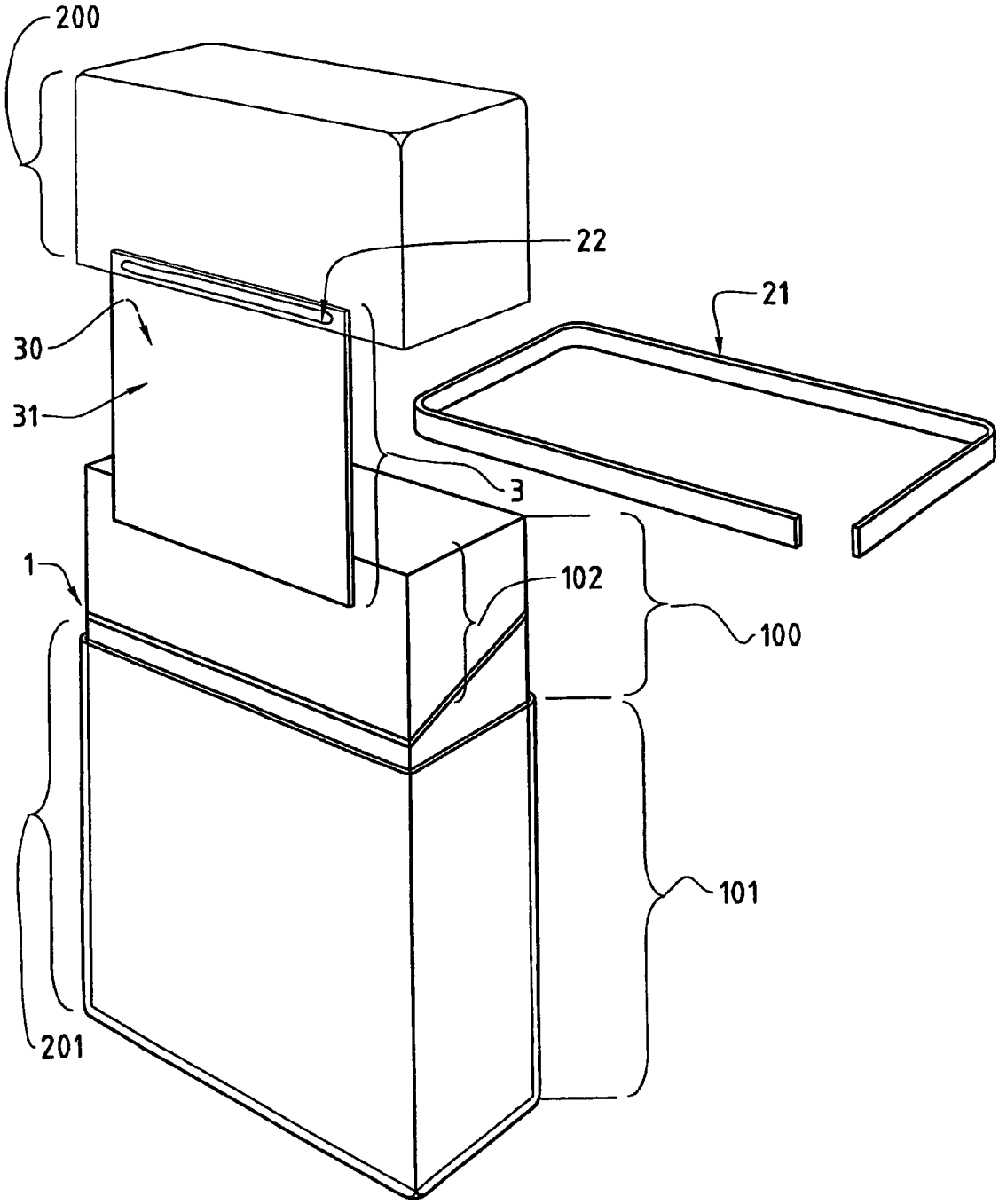
Figure 3:
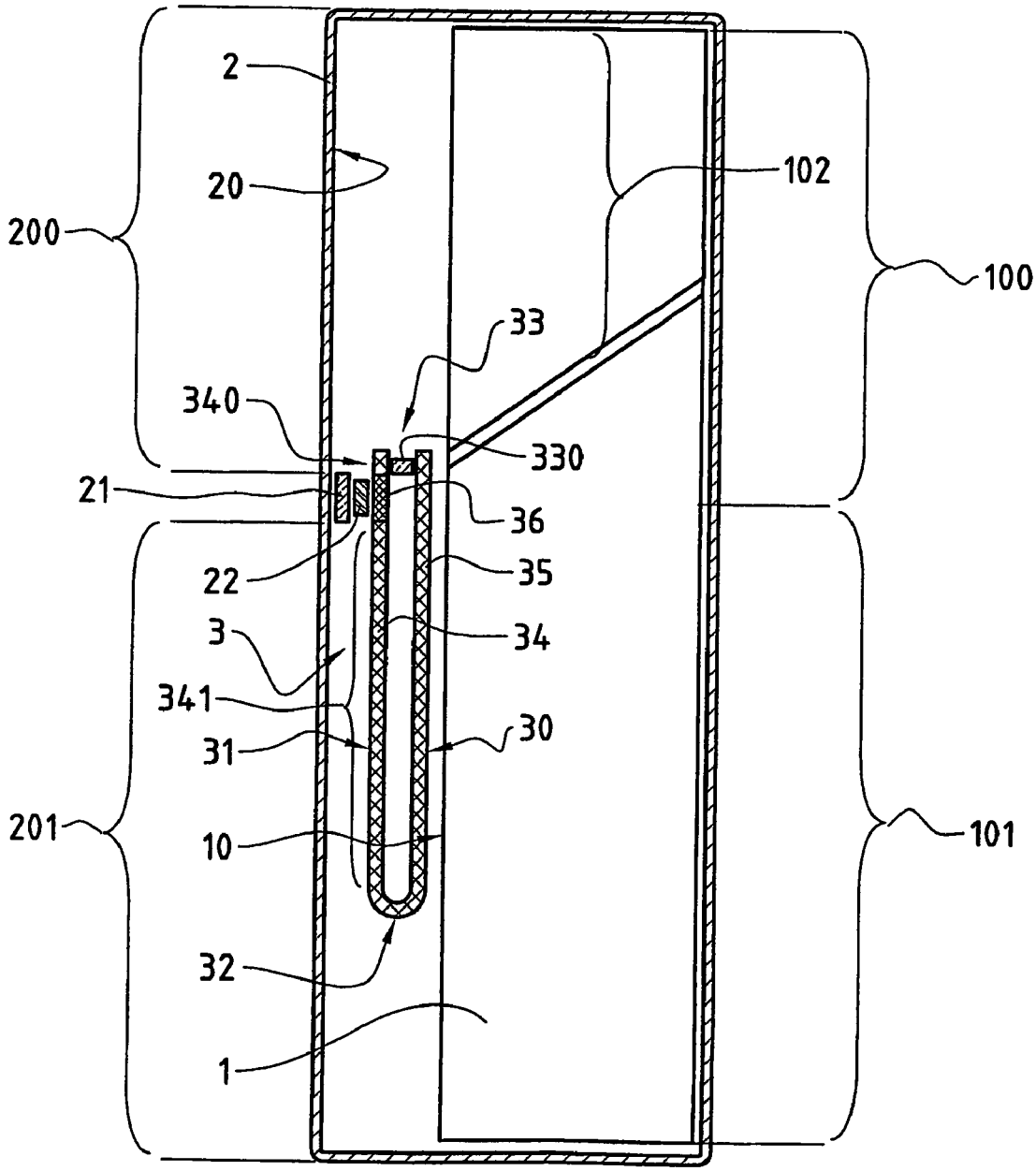

In FIGS. 1 to 3, there is a pack of cigarettes 1, e.g., of the stiff type, covered with a wrapping film 2, said film 2, which is, for example, made of transparent material such as cellophane, polypropylene, or any other material customarily used for this purpose. Although a stiff pack has been illustrated, it will be readily appreciated that the invention may be practiced using well know soft packs also. The nature of the pack is not critical to the practice of the invention.

The wrapping film 2 could also be made of an opaque material, for example, a printed opaque material.

As can be seen in the drawing, the pack 1 has at least one face 10, referred to as receiving face 10, against which a coupon 3 is placed, and the film 2 covers said pack 1 and said coupon 3.

The coupon 3 is a flat element, particularly but not exclusively a flat element of paper, which is intended to be placed between the film 2 and the said receiving face 10 of the pack 1.

When the coupon 3 is placed between the film 2 and the receiving face 10 of the pack 1, it shows two external opposite faces 30, 31 referred to as first and second external faces 30, 31.

The first external face 30 is placed against the receiving face 10 of the pack 1 and the second external face 31 is attached against a surface of the film 2 which, referred to as inner surface 20, is itself situated turned toward the pack 1.

The coupon 3 can be made up of a single sheet, and this single sheet can be folded or unfolded.

The coupon 3 can also be made up of two or more sheets, which can be folded or not.

When the film 2 is made of transparent material, the said second external face 31 of the coupon 3 appears through the film 2 (FIGS. 1 et 2).

The said second external face 31 of the coupon 3 is visible and may advantageously bear a logo, a publicity indication, or any other indication (not shown).

For opening the pack 1, the film 2 is conventionally provided here with a tear tape or tear strip 21 which is placed on the said inside face 20 of the film 2, and going around the side faces of the pack 1, one end of the tear tape 21 being advantageously provided with a tear tongue (not shown).

The tear strip 21 separates the film 2 into two portions, a first portion 200 and a second portion 201.

When the pack 1 is sold, certain information borne by the coupon 3, such as information (not shown) located on the first external face 30 of this coupon 3 that is placed against the receiving face 10 of the pack 1, are inaccessible.

Only opening of the film 2 makes possible access to said information borne by the coupon 3.

As is shown, the coupon 3 is fixed against the face referred to as the inner face 20 of the film 2 that is provided with a tear strip 21, in such a way that said tear strip 21 is situated between said coupon 3 and the film 2.

These technical features make it possible for the coupon to be protected by the wrapping film 2, and the coupon 3 does not have edges that can form as many abutments capable of impeding or hampering the displacements of the pack 1 when it has to be displaced and when its face 20, provided with the coupon 3, has to slide against guide surfaces of an installation (not shown).

Opening the film 2 by pulling on the tear strip 21 permits access to the coupon 3.

In a noteworthy way, the coupon 3 is fixed locally against the inner face 20 of the film 2 in such a way that after opening of said film 2 by means of the tear strip 21, said coupon 3 remains at least partly attached to one of said first portion 200 of the film 2, second portion 201 of the film 2 and tear strip 21 of said film 2.

In a noteworthy way, the coupon 3 is fixed locally against the inner face 20 of the film 2 by at least one first means of local attachment 22 selected from among the group of means comprising a point of adhesive, a line of adhesive, a welding point, a welding line, a crimping, the mechanical resistance of this means of local attachment 22 being adjusted such that it remains possible to separate the coupon 3 from the wrapping film 2, without destroying said coupon 3.

One skilled in the art will know how to adjust the mechanical resistance of said first means of local attachment 22 and/or how to provide a certain number of these means without further inventive step.

These technical features make it possible to ensure that the coupon 3 is not completely detached upon opening of the film 2 and thus does not escape from the person holding the pack without, however, hindering a possible separation of the coupon 3 and of the part of the wrapping film 2 that supports it.

These seemingly trivial features are in fact of particular importance because a coupon 3, which is generally smaller than the receiving face 10 of the pack 1, can easily escape from a person (not shown) who is holding the pack 1 and the tear strip 21.

The tear strip 21 separates the film 2 into two portions, i.e. a first portion 200 which is separated from a first part 100 of the pack 1 after opening of the film 2 and a second portion 201 which remains on a second part 101 of the pack 1 after opening of said film 2.

In a first noteworthy way, the coupon 3 is fixed locally against the inner face 20 of the film 2 in such a way that after opening of said film 2 by means of the tear strip 21, said coupon 3 remains attached to one of said first and second portions 200, 201 of said film 2.

This technical feature facilitates access to the coupon 3 by ensuring that it does not escape from a person holding said pack 1.

In a second noteworthy way, the coupon 3 is fixed locally against the inner face 20 of the film 2 in such a way that after opening of said film 2 by means of the tear strip 21, the said coupon 3 remains attached to the first portion 200 of said film 2 which must be separated from the pack 1 to allow access to the contents (not shown) of the pack 1 by displacement of a lid 102 with which said pack 1 is provided.

The first part 100 of the pack 1, freed of the film 2, can thus be opened, and the coupon 3 itself can be examined by a person, e.g. the person who has opened the film 2.

In a third noteworthy way, the coupon 3 is fixed locally against the inner face 20 of the film 2 in such a way that after opening of said film 2 by means of the tear strip 21, said coupon 3 remains attached to said tear strip 21.

As has been explained, it is possible for the coupon 3 to constitute a sheet, for example, having two external opposite faces 30, 31, referred to as first external face 30 and second external face 31, but it also possible for it to be composed of a folded up and closed sheet, i.e. a leaf that needs to be cut locally in order to permit access to the information it contains.

In FIG. 3, the coupon 3 is formed by a leaf, folded about a folding line forming a fold zone 32, a zone 33 of the coupon 3, referred to as the closed zone 33, opposite the said fold zone 32 being closed, e.g., by a closure means 330, e.g., a spot or a line of glue, or by crimping, so as to keep the coupon closed before opening of the wrapping.

It is also possible, instead of a folded leaf, to have two leaves assembled along the folding line 32, as well as along the said closed zone 33.

Whatever the case, the coupon 3 comprises two opposite sectors 34, 35, referred to as first sector 34 and second sector 35, of these a first sector 34 that is intended to be situated against the inner face 20 of the film 2, and a second sector 35 that is intended to be situated against the receiving face 10 of the pack 1.

In a noteworthy way,

- the said first sector 34 of the coupon 3 is provided with at least one line of weakened resistance 36 situated so as to separate the first sector 34 into two zones 340, 341, referred to as first zone 340 and second zone 341,
- said first sector 34 of the coupon 3 is fixed against the inner surface 20 of the film 2 in such a way that the opening of the film 2 by means of the tear strip 21 causes the opening of the coupon 3 and at least one of the first and second zones 340, 341 of this first sector 34 of the coupon 3 remains pinched between the receiving face 10 of the pack 1 and one of said first and second portions 200, 201 of said film 2.

Said first sector 34 of the coupon 3 is preferably fixed against the inner surface 20 of the film 2 in such a way that the opening of the film 2 by means of the tear strip 21 causes the opening of the coupon 3, and said first zone 340 of this first sector 34 of the coupon 3 remains attached to said first portion 200 of said film 2.

These technical features allow opening of the coupon to be achieved more or less simultaneously with the opening of the film 2 that covers the pack 1 while ensuring that a portion of the coupon 3 remains attached to a portion of the film 2.

In a noteworthy way, the line of weakened resistance 36 of the coupon 3 is oriented substantially parallel to the tear strip 21 of the film 2 and is situated at a predetermined distance from this tear strip 21 in such a way as to ensure the simultaneous opening of the film 2 and of the coupon 3.

One skilled in the art will know how to determine the aforementioned distance without further inventive step.

According to a preferred embodiment, the coupon 3 is disposed against the inner surface 20 of the film 2 in such a way that the tear strip 21 is substantially superimposed on the line of weakened resistance 36 of the coupon 3, and said coupon 3 is fixed to said inner surface 20 of the film 2 on the one hand, at least at the place where said tear strip 21 and said line of weakened resistance 36 are superimposed, and on the other hand, in at least one other separate place, and this in such a way that the opening of the film 2 by means of the tear strip 21 causes the opening of the coupon 3 and that, after opening of said film 2, at least one of said first and second zones 340, 341 of the coupon 3 remains pinched between the receiving face 10 of the pack 1 and one of said first and second portions 200, 201 of said film 2.

These technical features thus make it possible to ensure the opening of the wrapping film 2 and simultaneously the opening of the coupon 3.

The invention claimed is:

1. A wrapping formed around at least one pack by a wrapping film, the pack having at least one face against which a coupon is placed, the coupon having two opposite faces comprising a first face placed against the pack and a second face attached against an inner surface of the film, a tear strip disposed between the coupon and the film, opening of the wrapping film being achieved by the tear strip which separates the film into two portions, the coupon being fixed against the inner surface of the film whereby after opening of the film by the tear strip the coupon remains at least partly attached to a single one of the first portion of the film, the second portion of the film and the tear strip.

2. A wrapping as in claim 1 wherein the coupon is folded.

3. A wrapping according to claim 1 wherein the coupon is fixed against the inner surface of the film by an attachment selected from the group consisting of a point of adhesive, a line of adhesive, a welding point, a welding line and a crimping, and wherein resistance of the attachment is adjusted such that the coupon is separated from the wrapping film without destroying the coupon.

4. A wrapping according to claim 1 wherein the tear strip separates the film into two portions comprising a first portion separated from a first part of the pack after opening of the film and a second portion which remains on a second part of the pack after opening of the film and, wherein the coupon is fixed against an inner face of the film whereby after opening of the film by the tear strip the coupon remains attached to one of the first and second portions of the film.

5. A wrapping according to claim 1 wherein the tear strip separates the film into two portions comprising a first portion that is separated from a first part of the pack after opening of the film and a second portion that remains on a second part of the pack after opening of the film and wherein the coupon is fixed against an inner face of the film wherein after opening of the film by the tear strip the coupon remains attached to the first portion of the film which is separated from the pack to allow access to the contents of the pack.

6. A wrapping according to claim 1 wherein the tear strip separates the film into two portions comprising a first portion separated from a first part of the pack after opening of the film and a second portion which remains on a second part of the pack after opening of the film, and wherein the coupon is fixed against an inner face of the film whereby after opening of the film by the tear strip, the coupon remains attached to the tear strip.

7. A wrapping according to claim 1 wherein the coupon comprises a first sector and an opposite second sector, the first sector being situated against an inner face of the film and the second sector situated against a receiving face of the pack, and wherein the first sector of the coupon is provided with at least one line of weakened resistance constructed and arranged to separate the first sector into first and second zones, and wherein the first sector of the coupon is fixed against an inner surface of the film whereby opening of the film by means of the tear strip causes the opening of the coupon, and wherein at least one of the first and second zones, the first sector of the coupon remains pinched between the receiving face of the pack and one of first and second portions of the film.

8. A wrapping according to claim 7 wherein the line of weakened resistance of the coupon is substantially parallel to the tear strip of the film and is situated at a predetermined distance from this tear strip to effect simultaneous opening of the film and of the coupon.

9. A wrapping according to claim 7 wherein the coupon is disposed against the inner surface of the film whereby the tear strip is superimposed substantially on the line of weakened resistance of the coupon and the coupon is fixed to the inner surface of the film.

10. A cigarette pack covered by a wrapping according to claim 1.

* * * * *